US007083149B2

(12) United States Patent
Heinze et al.

(10) Patent No.: US 7,083,149 B2
(45) Date of Patent: Aug. 1, 2006

(54) CROSS FROG

(75) Inventors: Friedbert Heinze, Gotha (DE); Stefan Wenzel, Erfurt (DE)

(73) Assignee: VAE GmbH, Vienna (AU)

( * ) Notice: Subject to any disclaimer, the term of this patent is extended or adjusted under 35 U.S.C. 154(b) by 0 days.

(21) Appl. No.: 11/001,073

(22) Filed: Dec. 2, 2004

(65) Prior Publication Data

US 2005/0145754 A1 Jul. 7, 2005

(30) Foreign Application Priority Data

Dec. 2, 2003 (DE) ..... 103 56 719

(51) Int. Cl.
*E01B 7/00* (2006.01)

(52) U.S. Cl. ..... 246/472; 246/468

(58) Field of Classification Search ..... 246/468, 246/469, 472, 463, 460, 458, 456, 275, 274, 246/454, 385, 296
See application file for complete search history.

(56) References Cited

U.S. PATENT DOCUMENTS

| | | | | |
|---|---|---|---|---|
| 487,957 | A * | 12/1892 | McAdams | 246/274 |
| 1,313,780 | A * | 8/1919 | Betts | 246/275 |
| 2,377,273 | A | 5/1945 | Siebert | |

FOREIGN PATENT DOCUMENTS

| | | |
|---|---|---|
| DE | 2061264 | 7/1972 |
| DE | 326713 | 12/1975 |
| DE | 3519683 | 12/1986 |

* cited by examiner

*Primary Examiner*—Mark T. Le
(74) *Attorney, Agent, or Firm*—Dennison, Schultz & MacDonald

(57) ABSTRACT

A cross frog of a grooved rail junction plate having a cross frog tip movably arranged on a sliding plate, wing rails running along the same, as well as auxiliary rails that transition into connecting bars, which delimit a respective groove with an allocated section of wing rail. In order to adjust the cross frog tip within the desired range and to make possible a problem-free exchange in the case of a repair or upgrade with a simple design, it is proposed that the cross frog tip transition without connection into the auxiliary rails.

17 Claims, 4 Drawing Sheets

Figure 8
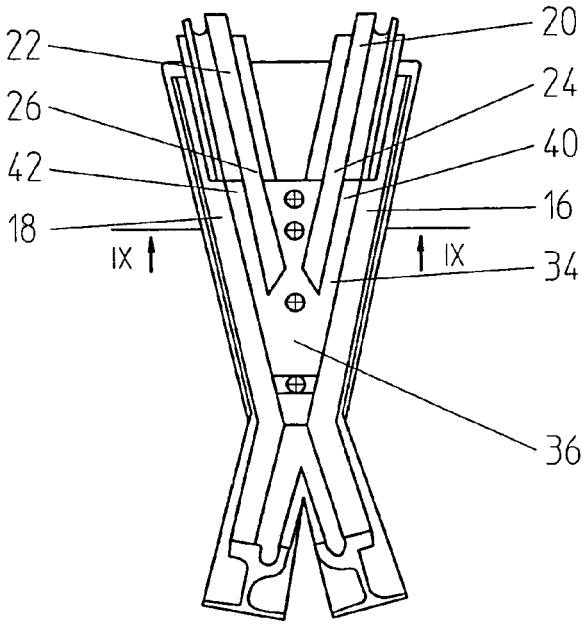
Figure 10
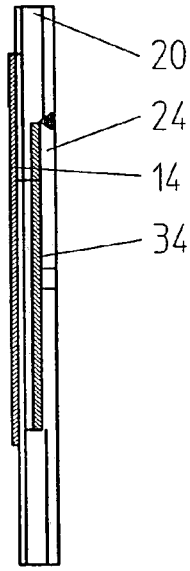
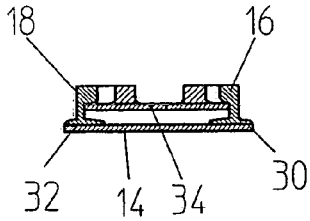
Figure 9

CROSS FROG

BACKGROUND OF THE INVENTION

The invention concerns a cross frog of a grooved rail junction plate having a cross frog tip movably arranged on a sliding plate, wing rails running along the cross frog tip, as well as auxiliary rails transitioning into connecting bars, which in turn delimit a groove with an allocated section of wing rail.

A corresponding cross frog can be found in AT 326 713. The cross frog tip forms a unit with the auxiliary rail, which in turn is screwed or welded to the connecting bars. The cross frog tip is moreover arranged on a sliding plate, which is supported on bases of the wing rails and the auxiliary rails.

In accordance with DE-A-35 19 683 in order to align the crossings in their correct position with respect to each other, the same are held by an ingot or a supported plate.

A spring-movable cross frog tip for flat bottom rails is known from U.S. Pat. No. 2,377,273.

In a cross frog for junction plates and crossings of a rail of flat bottom rails, the cross frog tip can be pivoted around an axis and has a stub-shaped projection, which extends between the connecting bars that run at a spacing from each other or the adapters connected thereto (DE-A-2061264).

SUMMARY OF THE INVENTION

It is the object of the invention to develop further a cross frog of the kind described above, wherein the cross frog tip has a simple design and can be adjusted within the desired range, making possible a problem-free exchange in the case of a repair or upgrade.

According to a further aspect of the invention, it should be ensured that an incorrect positioning of the cross frog tip is precluded and that a derailment can consequently be prevented.

According to the invention, the object is attained essentially in that the cross frog tip switches over without connection into the auxiliary rail.

Deviating from the prior state of the art, the cross frog tip is not connected to the auxiliary trail or connecting bar. Rather, the cross frog tip itself can be adjusted with respect to the auxiliary rail. Therefore, it is also not required that the cross frog tip have a spring-elastic configuration. The cross frog tip can consequently be configured as a short compact component, which can be adjusted in dependence upon the direction to be traveled.

For this purpose, it is provided that the cross frog tip switches over via a lap joint into the respective auxiliary rail, whereupon the lap joint to be traversed is closed in dependence upon the position of the cross frog tip and a gap runs in the remaining lap joint.

Particularly advantageous conditions result if the impact surface of the auxiliary rail facing toward the cross frog tip encloses an angle $\alpha$ at its travel edge with preferably $\alpha \approx 30°$, and the impact surface of the cross frog tip at the connecting line between the pivot point of the cross frog tip and the point of intersection between the impact surface and the travel edge of the cross frog tip enclose an angle $\beta$ of preferably about 90°.

A particularly stable design results if the auxiliary rail is configured as a four-edge profile of guide rail material. Moreover, the auxiliary rail should be welded to the sliding plate.

In order to be able to pivot the cross frog tip configured as a rigid component within the desired range, it is provided that the cross frog tip can be rotatably mounted on a pivot point plate going out from the sliding plate, wherein a mounting plate, which is connected to the pivot point plate, can extend over the surface along the cross frog tip.

The cross frog tip can be rotatably mounted in accordance with the invention between the pivot point plate going out directly from the sliding plate and the mounting or fixing plate connected thereto, whereupon in particular the pivot point plate is penetrated by a connector or collar, which is the bearing of the cross frog tip, and is connected, for example, screwed, to the mounting plate.

Other bearing possibilities are also possible.

The cross frog tip design should be constructed with a box-like design, wherein the upper boundary of the box is the sliding plate. The latter is connected, in turn, to a support structure, which goes out from the wing rails.

The box design is delimited on the underside by base plates, on which the wing rails are welded.

In a particularly emphasized further development of the invention is proposed a tip configured as a control tip and mounted ahead of the cross frog tip, which can be movably mounted on the sliding plate or one special sliding plate and is positively coupled to the cross frog tip in such a way that a switchover of the control tip leads to a switchover or adjustment of the cross frog tip in the travel direction.

By means of this measure, it is ensured that in the case of an incorrect travel, the cross frog tip rests always on the travel rail in correspondence with the position of the control tip, so that a danger-free passing through is ensured.

The cross frog itself is in particular a flatbed cross frog. The wing rails can consequently be configured as full-head rails with an internal positive side. This ensures the configuration of a stable movable cross frog tip with a good downshift.

The auxiliary rail can be connected via a lap joint to the connecting bar.

BRIEF DESCRIPTION OF THE DRAWINGS

Further details, advantages, and features of the invention result not only from the claims and the features disclosed therein (alone and/or in combination), but also from the following description of the preferred embodiments shown in the drawings, wherein:

FIG. 8 shows a plan view of the area of the cross frog of FIG. 1 with the cross frog tip removed, FIG. 9 shows a section along the line IX—IX of FIG. 8, and FIG. 10 shows a lateral view of the area of the cross frog of FIG. 8.

DESCRIPTION OF THE PREFERRED EMBODIMENTS

Different illustrations or sections of the flatbed cross frogs can be seen in the figures, wherein the described design is intended in particular for deep grooves with more than 80 mm, but without having as a result a limitation of the teaching of the invention.

Figure 1:
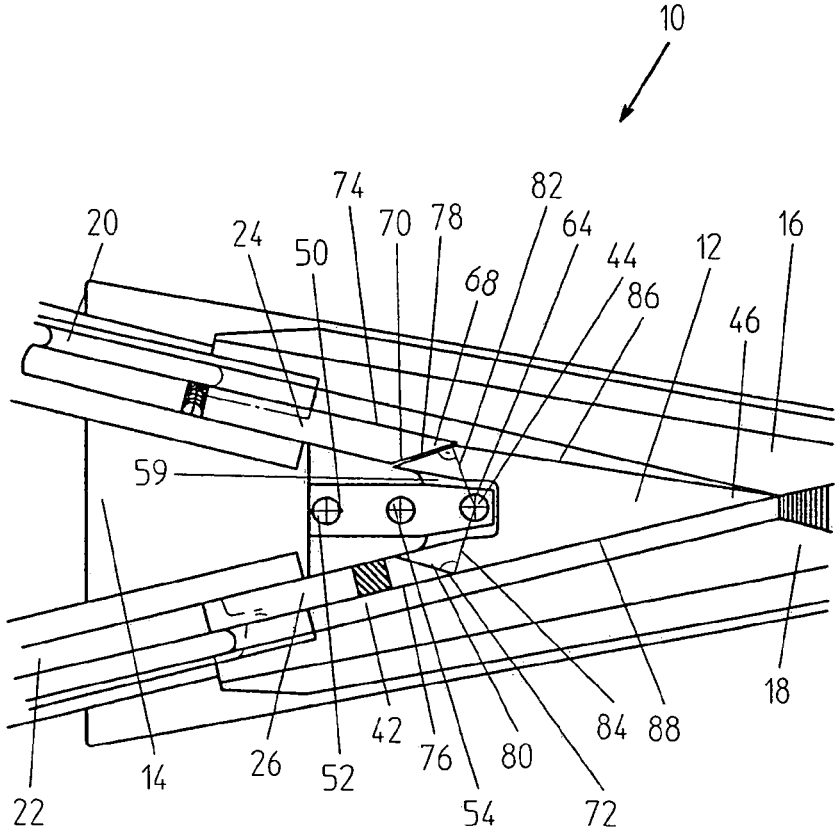
FIG. 1 shows a plan view of the area of a cross frog.

In FIG. 1 is shown a plan view of a cross frog 10 in box-like design having a movable cross frog tip 12. The cross frog 10 consists as is usual of a base plate 14 having wing rails 16, 18 welded thereon, as well as connecting bars 20, 22, which are connected to auxiliary rails 24, 26 via a lap joint 28. The auxiliary rails 24, 26 can also be sections of correspondingly processed connecting bars or grooved rails.

According to the section view of FIG. 9, a sliding plate 34 goes out from a support structure 30, 32 that goes out from the wing rails 16, 18, in whose front region 36 the cross frog tip 12 can move, that is, it can be pivoted in the actual sense and slidingly supported.

In the section view of FIG. 1, it can also be seen that the sliding plate can be connected so as to be vertically adjustable via, for example, a crosslock 66, to the support structure 32.

The auxiliary rails 24, 26, which are welded by means of the overlapping joint 28 (also called lap joint) to the connecting bars or grooved rails 20, 22, are in particular those consisting of rectangular profiles of guide rail material having an edge length of 80 mm. The auxiliary rails 24, 26 delimit with the wing rails 16, 18 running alongside thereof grooves 40, 42 that transition into the grooves of the connecting bars 20, 22.

According to the invention, the cross frog tip 12 is a rigid compact component that can be pivoted around an axis 44 in order to rest selectively with its tip 46 on one of the wing rails 16, 18 in dependence upon the passage direction through the cross frog 10.

Figure 2:
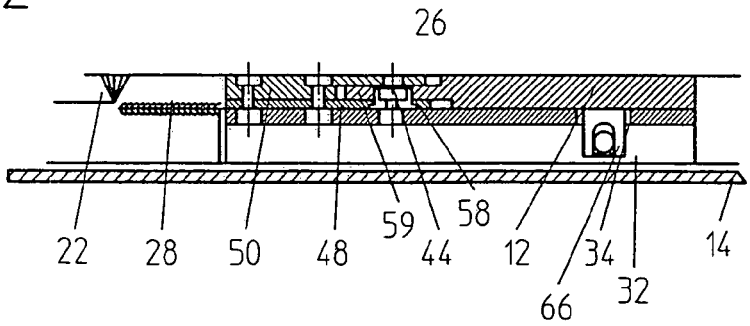
FIG. 2 shows a longitudinal section through the area of the cross frog of FIG. 1.
Figure 5:
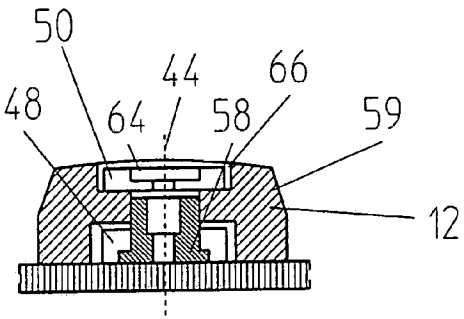
FIG. 5 shows a cross section through a unit of FIGS. 3 and 4, consisting of a sliding plate, pivot point plate, and mounting plate.
Figure 3:
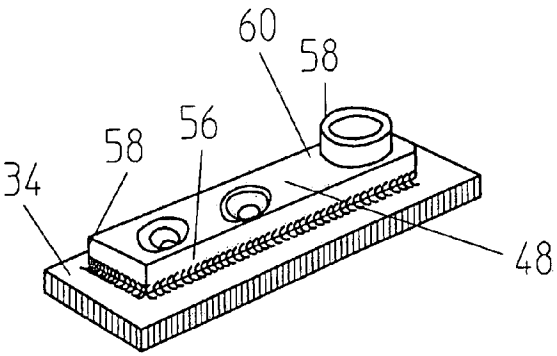
FIG. 3 shows a section view of a sliding plate with pivot point plate.
Figure 4:
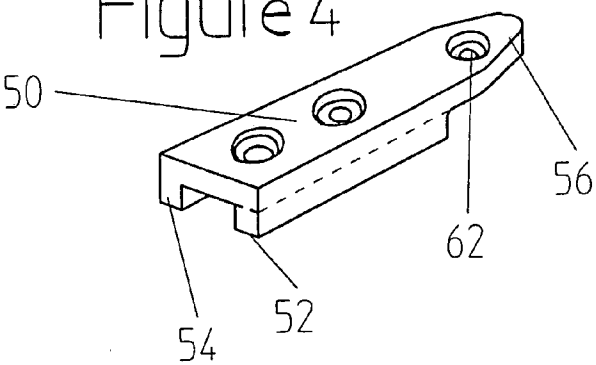
FIG. 4 shows a mounting plate.

In order to be able to pivot the cross frog tip 12, a pivot point plate 48 going out from the sliding plate 34, which is configured in block-like shape or cuboid shape, is welded to said sliding plate and a mounting or fixing plate 50 can be detachably mounted thereon. In accordance with the illustrations shown in FIGS. 2, 3 and 4, the mounting plate 50 encompasses moreover the pivot point plate 48 along its longitudinal sides. As a consequence, the mounting plate 50 has, with the exception of its front area 56, a U-geometry in section, whose lateral legs 52, 54 extend along longitudinal lateral walls 56, 58 of the pivot point plate 48. The mounting plate 50 is moreover detachably connected to the pivot point plate 48 welded to the sliding plate 34 via studs 52, 54 or other suitable connecting. elements.

The front area 56 of the mounting plate 50 extends above a connector or collar 58, which is an insert in the pivot point plate 48. In the intermediate space between the front section 56 of the mounting plate 50, which extends above the connector of the collar 58, and the upper side 60 of the pivot point plate 48, runs a rear section 59 of the cross frog tip 12, which is penetrated by the connector 58 in correspondence to the section view according to FIG. 8 and consequently forms bearings for the cross frog tip 12, and therefore specifies the rotation axis 44. A breakthrough 62 aligned with the connector of the collar 58 is arranged on the mounting plate 50, which is penetrated by a stud 64 that can be screwed into the connector of the collar 58.

The cross frog tip 12 has a section in the area of the pivot point plate 48 in order to make possible a pivoting. On the upper side of the cross frog tip 12, in the area of the mounting plate 50, is also provided a recess or cavity 66, into which runs the mounting plate 50. The depth of the recess 66 with respect to the thickness of the mounting plate 50 is coordinated in such a way that the upper side of the mounting plate 50 runs within the recess 66 or aligned with respect to the outer surface of the cross frog tip 12. On the other hand, however, it is ensured that the cross frog 12 can be pivoted toward the mounting plate 60. As a consequence, and induced by the described design, the cross frog tip 12 has a H-shaped geometry in section in its rear area 59.

The connector 58 of the pivot point plate 48 and the coaction with the rear section 59 of the cross frog tip 12, taking into consideration the mounting plate 50 and if required any existing spacer washers, ensure the rotational mobility of the cross frog tip 12 within the desired range.

An even transition to one of the auxiliary rails 24 or 26 occurs, on the one hand, in dependence upon the position of the cross frog tip 12 because said tip is a rigid component. On the other hand, a gap forms with respect to the other auxiliary rails 26 or 24. In order to cross the groove 42, the cross frog tip 12 rests with its tip 46 on the wing rail 16 in accordance with the depiction of FIG. 1. At the same time, the cross frog tip 12 transitions evenly into the auxiliary rail 26 that delimits the groove 42. A gap 68 forms instead between the cross frog tips 12 and the auxiliary rail 24.

In order to make possible the corresponding adjustments of the cross frog tip 12 with respect to the auxiliary rails 24, 26, the auxiliary rail 24, 26 has an impact surface 70, 72 running alongside the cross frog tip, which encloses an angle $\alpha$ of preferably 30° with respect to the travel edge 74, 76. The impact surface 78, 80 of the cross frog tip 12, instead, encloses an angle $\beta$ of preferably 90° with respect to a straight line 82, 84, which connects the rotation axis 44 with the point of intersection of the impact surface 78, 80 to the travel edge 86, 88 of the cross frog tip 12.

Because of these structural design conditions, the impact surfaces are planarly superimposed in the direction of travel, whereas in the direction that is not traveled is formed a gap (the gap 68 in the exemplary embodiment of FIG. 1).

Figure 6:
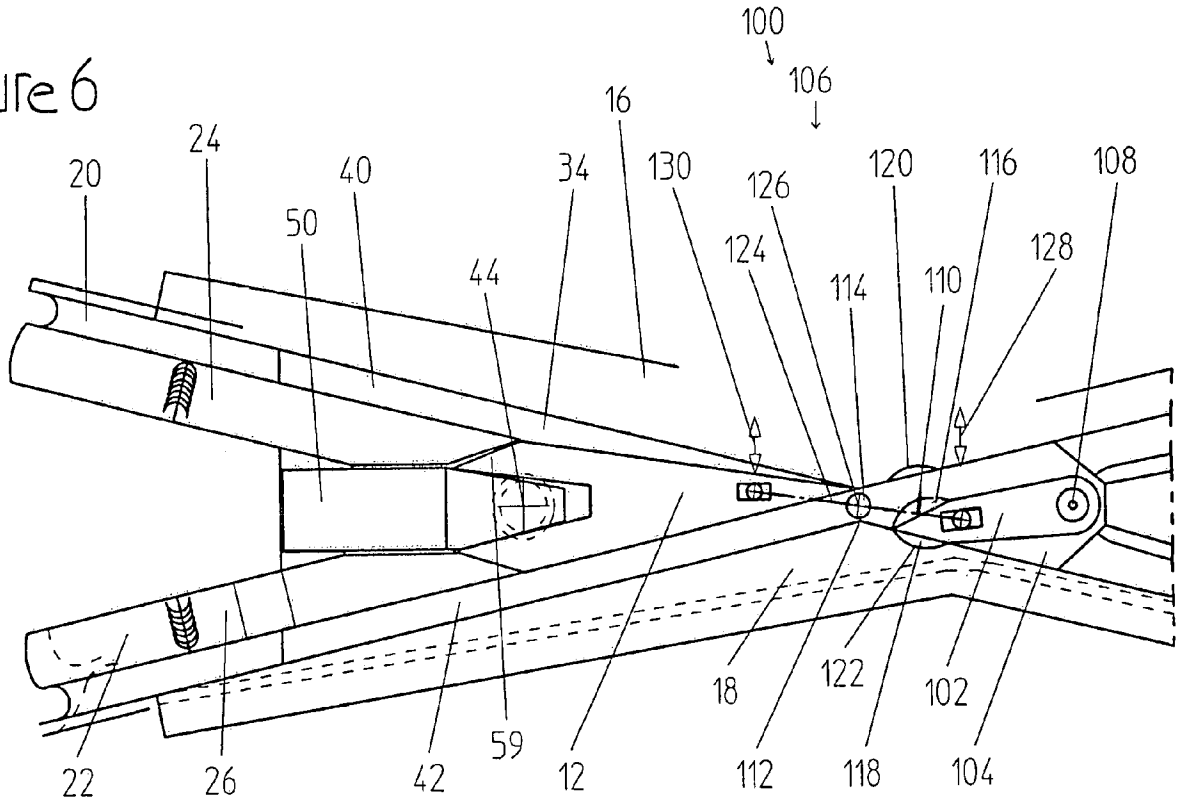
FIG. 6 shows a further embodiment of the area of a cross frog.
Figure 7:
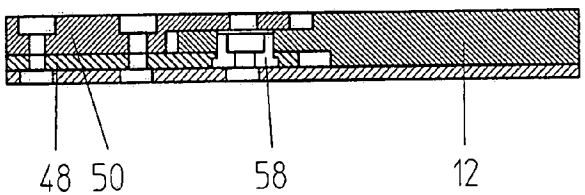
FIG. 7 shows a longitudinal section through the area of the cross frog of FIG. 6.

In FIGS. 6 and 7 is shown a supplement of the teaching of the invention, wherein the same reference numerals are utilized for the same elements, in accordance with the exemplary embodiment of FIGS. 1 through 4 and 8 through 10. Thus, the area 100 of a cross frog shown in the plan view of FIG. 6 also exhibits a so-called control tip 102, which is pivotably arranged on a sliding plate 104, which runs opposite to the sliding plate 34 with reference to the groove crossing point 106 of the area 100 of the cross frog on which the cross frog tip 12 is pivotably arranged. The control tip 102 is pivotably mounted around an axis 108, which extends parallel to the rotation axis 44 of the cross frog tip 12.

The control tip 102 runs with its tip 110 preferably recessed, that is, at a spacing from the break point 112, 114 of the wing rails 16, 18, while the break point 112, 114 is within the area of the crossing point 106 of the grooves 40, 42.

According to the illustration of FIG. 6, the tip 110 of the control tip 102 can have outwardly bent sections 116, 118 in its lateral walls, whose corresponding moldings 120, 122 are allocated to the wing rails 16, 18 in order to make possible an even abutment.

The control tip 102 is coupled to the cross frog tip 12 in such a way according to the invention, that it is ensured that the cross frog tip 12 is constantly adjusted in the travel direction, in order to preclude an incorrect travel and thereby prevent a derailment, if required. The positive coupling can occur via a swinging fork 124, which can be pivoted around an axis or a pivot point 126. The swinging fork 124 is connected thereafter to the cross frog tip 12 and to the control tip 102.

In order to adjust the cross frog tip 12 and thereby the control tip 102 is provided a drive, which can be operated, for example, electrically or hydraulically. A manual adjustment can also be considered. In the exemplary embodiment, the drive should preferably be allocated to the control tip 102 (symbolized with the double arrow 128), even though the cross frog tip 12 should be (preferably) actively driven. A linkage tester should likewise be provided, which is indicated by the double arrow 130. The linkage tester 130, swinging fork 124, and drive 128, including the corresponding pivot points 114, run below the sliding plates 34, 104, which can also be configured as one piece.

What is claimed is:

1. A cross frog of a grooved rail junction plate having a cross frog tip (12) movably arranged on a sliding plate (34), wing rails (16, 18) running along said cross frog tip, as well as auxiliary rails (24, 26) transitioning into connecting rails (20, 22), said connecting rails delimit a groove (40, 42) with an allocated section of wing rails, wherein the cross frog tip transitions into the auxiliary rails (24, 26) without connection, said cross frog tip (12) is a rigid compact component and pivotable around a rotation axis (44), a pivot point plate (48) that goes out from the sliding plate (34), and a mounting plate (50) is connected to the pivot point plate (48), said mounting plate extends over upper surface side of the cross frog tip (12) in a rear area (59) and said cross frog tip is with its rear area (59) rotatably mounted between said pivot point plate (48) and said mounting plate (50).

2. The cross frog of claim 1, wherein the cross frog tip (12) transitions into the corresponding auxiliary rail (24, 26) via a lap joint, whereat the lap joint to be traversed is closed in dependence upon the position of the cross frog tip and a gap runs into the remaining lap joint.

3. The cross frog of claim 1, wherein an impact surface (70, 72) of the auxiliary rail (24, 26) facing the cross frog tip (12) encloses an angle $\alpha$ at its travel edge (74, 76), preferably with $\alpha \approx 30$ °.

4. The cross frog of claim 1, wherein the cross frog tip (12) encloses with an impact surface at a straight line (82, 84) an angle $\beta$, preferably with $\beta \approx 90$ °, whereas the straight line connects the pivot point (44) of the cross frog tip and the point of intersection of the impact surface (78, 80) and a travel edge (86, 88) of the frog.

5. The cross frog of claim 1, wherein the auxiliary rail (24, 26) is a four-edge profile of guide rail material and is welded on the sliding plate (34).

6. The cross frog of claim 1, wherein a connector or collar (58) goes out from or penetrates the pivot point plate (48), whereas the connector or collar supports the cross frog tip (12).

7. The cross frog of claim 1, wherein the wing rails (16, 18) are welded to a base plate (14) in a box-like design.

8. The cross frog of claim 1, wherein a support structure (30, 32) goes out from the wing rails (16, 18), on which the sliding plate (34) is mounted, preferably so as to be vertically adjustable at a spacing to the base plate (14).

9. The cross frog of claim 1, wherein the cross frog tip (12) has a recess (66) or cavity on the top side, in its area enclosing the pivot point plate (48), within which the mounting plate (50) runs in such a way that a relative motion between the cross frog tip (12) and the mounting plate is possible.

10. The cross frog of claim 9, wherein the mounting plate (50) runs on the outer surface within the recess or cavity (66) of the cross frog tip (12) or even with respect to the surface of the cross frog tip.

11. The cross frog of claim 1, wherein the cross frog tip (12) has a H-shaped geometry in section in the area that encloses the pivot point plate (48).

12. The cross frog of claim 1, wherein a movable control tip (102), which is arranged opposite to the cross frog tip (12) with reference to the crossing point of grooves (40, 42) of the cross frog (10, 100), is allocated to the cross frog tip (12).

13. The cross frog of claim 12, wherein the cross frog tip (12) and the control tip (102) are connected to each other in a positive coupling in such a way that with a switchover of the cross frog tip occurs a switchover of the control tip and vice versa.

14. The cross frog of claim 1, wherein the cross frog (10, 100) is a flatbed cross frog.

15. The cross frog of claim 1, wherein the cross frog (10, 100) is a deep-groove cross frog.

16. The cross frog of claim 1, wherein the wing rails (16, 18) are fullhead rails with internal positive sides.

17. The cross frog of claim 1, wherein the auxiliary rail (24, 26) can be connected possibly by welding to a connecting bar (20, 22) via a lap joint (28).

* * * * *

UNITED STATES PATENT AND TRADEMARK OFFICE

CERTIFICATE OF CORRECTION

PATENT NO. : 7,083,149 B2
APPLICATION NO. : 11/001073
DATED : August 1, 2006
INVENTOR(S) : Friedbert Heinze et al.

It is certified that error appears in the above-identified patent and that said Letters Patent is hereby corrected as shown below:

On the title page:

(73) Assignee: Change "VAE GmbH, Vienna (AU)" to --VAE GmbH, Vienna (AT)--; and add the following Assignee:

BWG GmbH & Co. KG, Butzbach (DE)

Signed and Sealed this

Nineteenth Day of February, 2008

JON W. DUDAS
*Director of the United States Patent and Trademark Office*